United States Patent [19]

Reuss et al.

[11] Patent Number: 4,702,708

[45] Date of Patent: Oct. 27, 1987

[54] PLUG-TYPE CONNECTOR MODULE CARRYING A PRINTED CIRCUIT BOARD

[75] Inventors: Oswald Reuss, Unterelsbach; Karl L. Otto, Bad Neustadt/Saale, both of Fed. Rep. of Germany

[73] Assignee: Preh, Elektrofeinmechanische Werke, Jakob Preh, Nachf, GmbH & Co., Bad Neustadt/Saale, Fed. Rep. of Germany

[21] Appl. No.: 756,863

[22] Filed: Jul. 18, 1985

[30] Foreign Application Priority Data

Jul. 18, 1984 [DE] Fed. Rep. of Germany ..... 3426411
Jul. 28, 1984 [DE] Fed. Rep. of Germany ..... 3428006

[51] Int. Cl.[4] ..... H01R 9/09

[52] U.S. Cl. ..... 439/83; 439/76; 156/292

[58] Field of Search ..... 339/17 R, 17 C, 17 LC, 339/17 LM, 193 P; 361/392, 395, 399, 406, 408; 338/162, 168; 156/290, 291, 292, 257; 174/117 A

[56] References Cited

U.S. PATENT DOCUMENTS

| | | | |
|---|---|---|---|
| 2,727,737 | 12/1955 | Dole | 52/603 |
| 3,345,622 | 10/1967 | Matsushita | 361/408 |
| 3,526,397 | 9/1970 | Verguson | 269/7 |
| 3,761,336 | 9/1973 | Quinif | 156/292 |
| 4,159,505 | 6/1957 | Carp et al. | 361/408 |
| 4,357,069 | 11/1982 | Milora | 339/17 C |
| 4,422,128 | 12/1983 | Zurlinden et al. | 339/17 LC |
| 4,471,339 | 9/1984 | Fukada et al. | 338/162 |

FOREIGN PATENT DOCUMENTS

| | | | |
|---|---|---|---|
| 2321828 | 11/1973 | Fed. Rep. of Germany . | |
| 2849610 | 5/1979 | Fed. Rep. of Germany . | |
| 3029321 | 2/1981 | Fed. Rep. of Germany . | |
| 368530 | 5/1963 | Switzerland | 174/117 A |

OTHER PUBLICATIONS

"Throttle Valve Potententiometer Engineering Drawings".

*Primary Examiner*—Neil Abrams
*Attorney, Agent, or Firm*—Woodcock Washburn Kurtz Mackiewicz & Norris

[57] ABSTRACT

The invention pertains to a plastic plug-type connector module which carries a printed circuit board made of ceramic. A plurality of plug members each have a rear projecting end soldered to a contact member made from a spring material, and have another portion embedded by injection molding in an insulating carrier body. The contact members in turn make contact with edge contact surfaces of the printed circuit board. In order to simplify the manufacture and to achieve soldering guaranteeing reliable contact, part of a perforated band from which the contact member is cut off is left in place. This part is also used to solder the contact member to the plug member. In order to align the surface of the printed circuit board as exactly as possible parallel to a first, flat surface of the module, there are provided molded locally limited elevations with different heights on a second flat surface which carries the printed circuit board. The height is determined after measurement of the distance between the first and second surfaces in such a way as to achieve compensation. The printed circuit board is glued to the second surface.

6 Claims, 9 Drawing Figures

PLUG-TYPE CONNECTOR MODULE CARRYING A PRINTED CIRCUIT BOARD

BACKGROUND OF THE INVENTION

The present invention pertains to a plug-type connector module carrying a printed circuit board and, in particular, a plug-type connector having a plurality of plug elements which are connected to a printed circuit board mounted thereon.

Plug-type connector modules are used, for example, in the electronic fuel injection systems of automobiles, where the mixture enrichment during start, warm-up and acceleration is controlled electronically. The air-fuel ratio is influenced by means of a start flap. A second actuator on the throttle valve provides for the correct charging. A so-called throttle valve potentiometer which is connected with the throttle valve shaft by means of a coupling is used to indicate the position and the movement of the throttle valve. The printed circuit board of the plug-type connector module essentially consists of a potentiometer with a resistor strip located between two terminals and a parallel collector strip, both of which are contacted with a sliding contact. The voltage is supplied and the tapped voltage is transmitted to the electronic system by means of a plug-type connection. A device of this general type for detecting the operation of a throttle valve of a carbureator is described in West Germany patent publication DE-PS No. 3,029,321. A throttle valve which is connected with the sliding contact of a potentiometer is located in the suction channel of the carbureator. The tapped voltage is sent via an amplifier to two scanning and interception circuits which in turn are connected with an operation amplifier comparator. The output voltage is an indicator of the angular velocity of the throttle valve. When the throttle valve stops or rotates in the plug-type connector module-site direction, the output voltage of the comparator disappears.

A throttle valve potentiometer is already known which consists of a plastic insulating body which carries a ceramic plate with a resistor strip and with a collector strip as an applied printed circuit. A plug connector part is injection molded in the insulating body. This part consists of a projecting plug member and a rear contact member which serves the purpose of electrically connecting the plug member with the printed circuit. The plug member is a flat plug or a round plug made of dimensionally stable material. However, the contact member consists of a relatively soft spring material. One of the ends of the contact member is welded to the flat plug, from which the material of the insulating body is injection-molded around it. The other end of the contact member fits into perforations of the ceramic substrate and is soldered there by hand to edge contact points. When a round plug is used, the contact member is inserted into a centric cavity of the round plug, soldered at the free end and subsequently ground off, which is relatively labor-intensive. The contact member also has an arc-shaped deformation in order to better compensate the differences in the expansion of the material under the effect of temperature variations. Since the contact member consists of a relatively soft spring material, difficulties can arise due to unintended bending of the contact member during the injection-molding process. The manual soldering of the contact member to the edge contact points in the perforations is a source of contact uncertainty which is manifested in a higher failure rate.

The insulating body consists of a base with a flat first surface. From this surface rises a table mountain-like carrier part on whose second surface the printed circuit is disposed. The second surface or the printed circuit should lie as exactly parallel to the first surface as possible. However, since the insulating body is made of plastic, it is subject to the ordinary technological shrinkage tolerances which are dependent on the shape of the body. Measurements have shown that the deviations amount to more than 100 um (microns). In addition, the ceramic plate of the printed circuit is not perfectly flat either. However, the tolerances here are only about 10 um. The printed circuit is held in place on the carrier part by an adhesive. This adhesive has the property of contracting due to shrinkage, such that mechanical stress is generated in the printed circuit. It should be borne in mind in this connection that the range of application can extend to as high as 150° C. Since the second surface is not exactly parallel to the first surface, and since the surface of the printed surface is aligned to the first surface, it may occur that the printed circuit fits snugly on the carrier part in one area of the first surface, while in another area it may have a gap in excess of 100 um. Even though this is compensated by a thicker adhesive layer, the adhesive mass does not harden but must follow the temperature variations. It can also happen that the adhesive mass is squeezed out and causes contamination in the areas where the printed circuit fits the carrier part snugly.

A soldered tab for printed circuits whose end is shaped as a clamp is already known from West Germany patent publication DE-OS No. 2,849,610. At the edge this clamp is pushed onto the printed circuit. Part of the clamp carries a solder globule which melts under the action of heat and establishes electrical connection between the solder tab and the edge contact point of the printed circuit. The solder tabs are attached to a one-piece perforated band. After the solder tabs are soldered, the sliding contact is cut. A conductor can subsequently be soldered to the perforations.

SUMMARY OF THE INVENTION

The object of the present invention is to provide an improved plug-type connector module in the form useful for a throttle valve potentiometer or the like. The connector module can be used with round plugs or flat plugs and is designed to provide for simple but reliable soldering for both the contact member/plug member point and the contact member/printed circuit point, using a simple ceramic substrate for a printed circuit board without edge-contacting perforations.

In accordance with the above object, there is provided an apparatus, and method of making same, comprising a plug-type connector module. An insulating carrier body has a first lower surface, and a parallel upper surface for carrying a printed circuit board, for example a board containing elements of a potentiometer. There are a plurality of plug connection parts, each having a front plug member with at least a portion embedded within the body and a lower prong portion extending out of the bottom of the body; and a flexible contact member which connects at one end to the plug member and at the other end to the printed circuit board. The contact members are formed on a band which has a base portion with an opening (or perforation) at one end of each such base member. Upon assembly, each contact member is cut from the band so as to provide at one end the part containing an opening, or hole, the hole being adapted of a size as to accommodate the upper end of the front plug member which is soldered there to the contact member.

DESCRIPTION OF THE PREFERRED EMBODIMENTS

Figure 1:
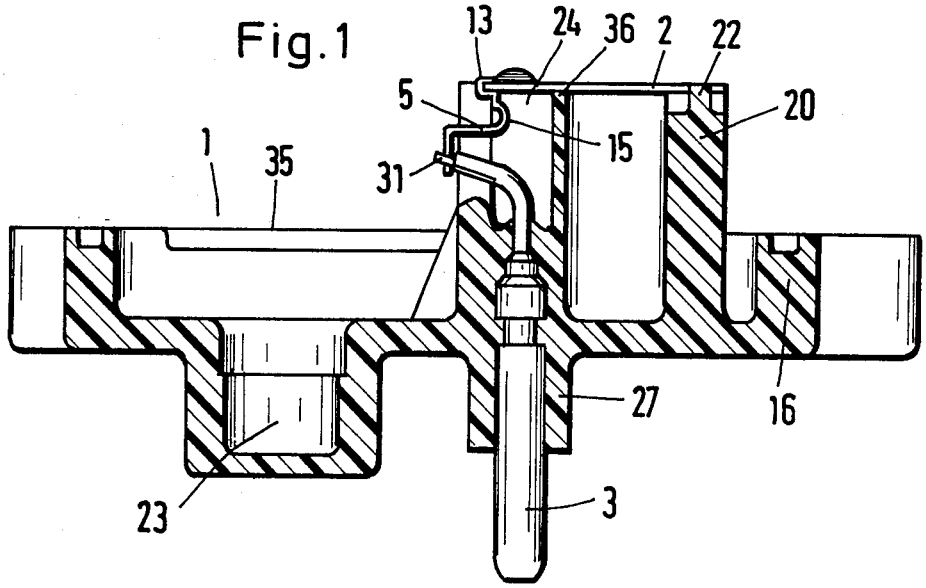
FIG. 1 is a logitudinal section through a plug-type connector module in accordance with this invention.
Figure 2:
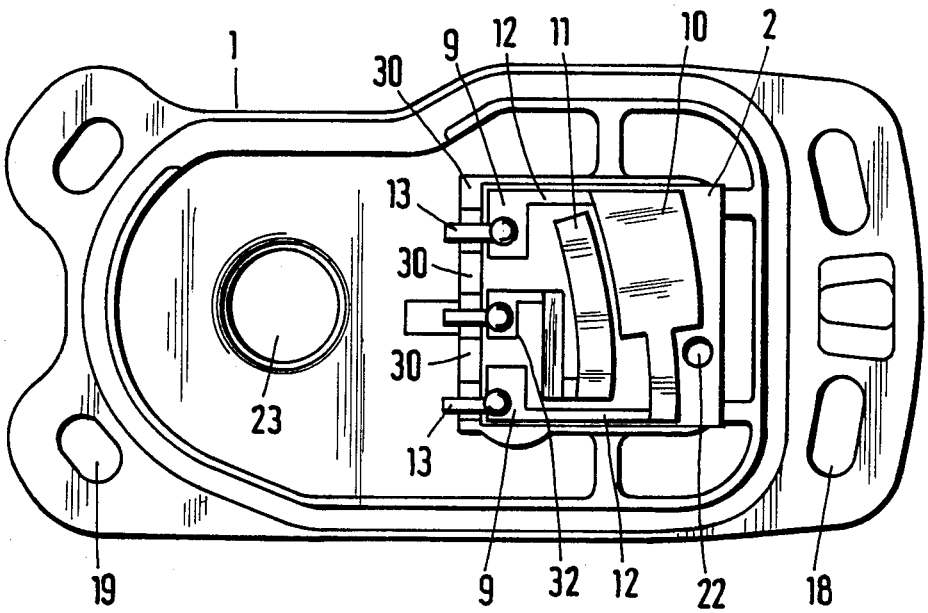
FIG. 2 is a top view of the plug-type connector module of FIG. 1.

An insulating carrier body is designated by 1 in FIGS. 1 and 2. The carrier body has an oblong, e.g., substantially rectangular base 16 on whose top side there are provided a table mountain-like carrier part 20 and, approximately opposite on the lower side, an extension 27. A recess 23 is also provided on the lower side which serves as a support for a shaft. One elongated hole 18, 19 is provided in each of the four corners of the base 16, which holes are used for adjusting and subsequently fastening the insulating carrier body.

A printed circuit board 2 in the form of a rectangular ceramic plate, having a strip resistor 10 applied thereon, e.g., by the screen printing method, is disposed on the carrier part 20. Both ends of the strip resistor 10 are connected with edge contact surfaces 9 through conductor strips 12 extending along the edge of the printed circuit board. These conductor strips consist of conducting silver and they are also applied by screen printing. Parallel to the strip resistor 10 extends a collector strip 11. To prepare it, a strip of conducting silver is first applied, after which it is topped by a strip resistor preferably from the same resistor paste from which the strip resistor 10 was prepared. Since the conducting silver strip and the superjacent resistor strip are connected with each other electrically over the entire length, a collector strip 11 with a low ohmic resistance is thus obtained. This method was selected to prepare the collector strip in order to provide a longer life element, since the silver strip by itself is not as abrasion-resistant as the strip resistor. The corresponding sliding contact which establishes an electrical connection between the strip resistor 10 and the collector strip 11 is not shown in the Figures. The collector strip itself is connected electrically with an edge contact surface 32 via conductor strips and a protective resistor.

As is apparent from FIG. 2, the strip resistor 10 consists of two sections, the narrower section having at least partly a subjacent silver strip at its end in the vicinity of the conductor strips. The broader section which is the actual resistor section extends only over a relatively narrow angular segment relative to the axis of the shaft as the fulcrum point of the sliding contact, which said axis is located in the recess 23, so that exact setting and adjustment are necessary.

Figure 3:
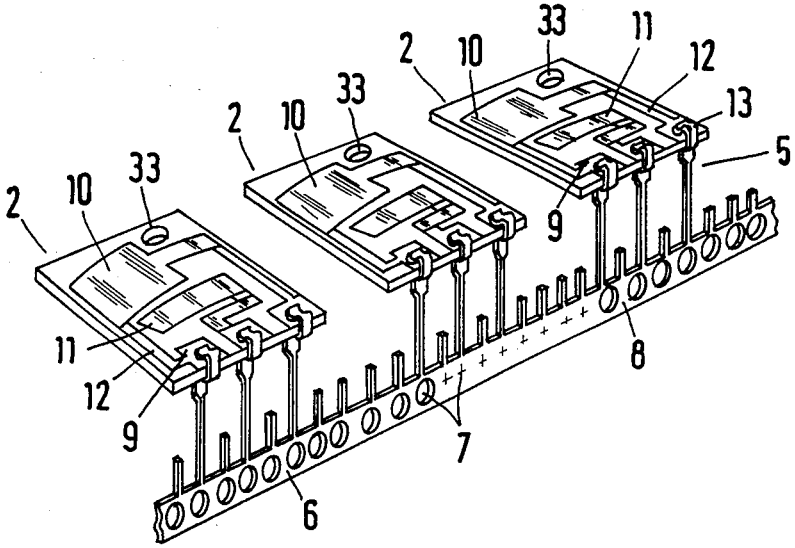
FIG. 3 is a perspective view of a band with cut-out contact members and printed circuits attached to these contact members, as used in this invention.

The printed circuit 2 is positioned exactly on the surface of the table mountain-like carrier part 20 by means of an adjusting pin 22 molded to the carrier part and which reaches through a round hole 33 in the printed circuit 2 (see also FIG. 3). On the side of the carrier part 20 opposing the adjusting pin 22 there are provided edge stops 30 projecting at the edge (see also FIG. 7), on which the printed circuit board 2 rests. The exact position of the printed circuit board 2 is thus defined.

Three round plug members 3 are also embedded by injection molding during the manufacture of the insulating carrier body. These plug members 3 are prepared from a round stock by turning. The embedding by injection molding is carried out together with the shaping of the entire insulating carrier body in such a way that the thick section projects at the bottom from the molded extension 27. As is apparent from FIG. 4, the rectangular extension 27 has projecting lugs 29 at each side, by means of which the socket holding the plug members can be snapped on and held in position.

Figure 4:
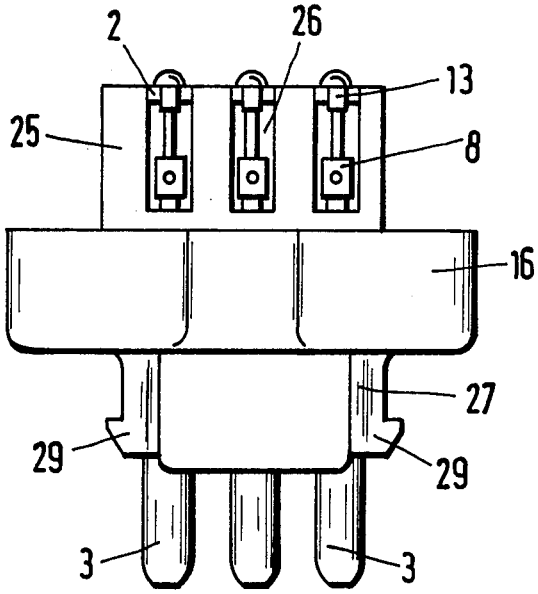
FIG. 4 is a lateral view of the plug-type connector module of this invention.

A recessed chamber 24 is positioned on the top side of the base 16 in the carrier part 20 above the extension 27. A section of the plug member 3 which is thinner than the thick section on the extension extends into this chamber. This thinner section is bent and led out through a hole 26 in the wall (FIG. 4). The end 31 of this thinner section tapers further compared with the thinner section, so that it can be easily introduced into a perforation 7 of band 6.

Figure 5:
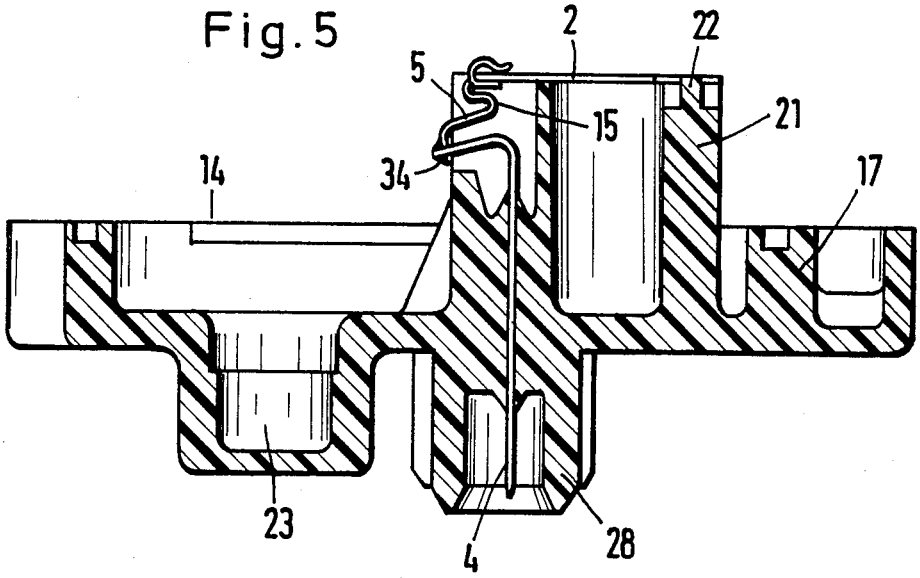
FIG. 5 is a longitudinal section through another embodiment of plug-type connector module in accordance with this invention.

The band 6, made of spring material with the cut-out contact members 5, is shown in FIG. 3 in a perspective view. The free end 13 of each contact member 5 has either a symmetrical or, as is shown in FIG. 5, an asymmetrical contour relative to the mid-plane of the clamp contour. The printed circuit board 2 is pushed into the free ends 13 of the contact members 5, clamped and soldered in the solder bath, so that the contact members 5 are connected with the edge contact surfaces 9, 32 of the circuit board 2 electrically and mechanically. After soldering, the contact members 5 are cut off from the band 6 by hand in such a way that a part 8 of the band 6 is left with one perforation 7. The perforation 7 is located exactly in line with the contact member 5. After the contact members 5 have been cut off, the contact members are provided with an arc-shaped deformation 15. This deformation serves to compensate the differences in the expansion of the material during broad temperature variations. It is also within the invention to provide the arc-shaped deformation 15 before the contact members are cut off.

For assembly, the perforations 7 of the contact members 5 are simply pushed over the ends 31 of the plug members 3, the printed circuit board 2 is then mounted on the surface 36 of the carrier part, whereby the side of the printed circuit board on which the edge of the contact surfaces 9, 32 are located come to rest at the edge stop 30. In addition, the mounting is carried out in such a way that the hole 33 receives the adjusting pin 22. The contact members 5 are finally soldered to the plug members 3 without difficulties, because the contact members 5 and the ends 31 of the plug members project from the hole 26 in the outside wall 25 of the chamber.

Figure 6:
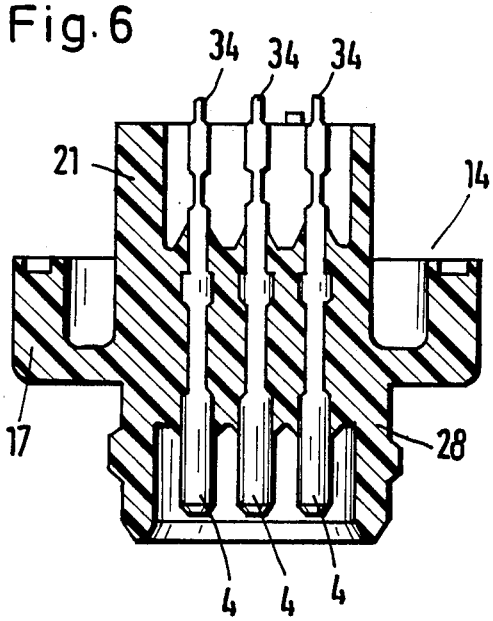
FIG. 6 is a section through the front view of the plug-type connector module of FIG. 5 without a printed circuit board.

Another example of a plug-type connector module is shown in FIGS. 5 and 6. In contrast to the first embodiment in which a round plug member 3 is used, a flat plug member 4 is used in this embodiment. This plug member 4 is embedded in one piece in the insulating carrier body 14 by injection molding. FIG. 6 shows a section through the insulating carrier body 14 after the injection molding and before the rear part of the plug member 4, provided with predetermined bending points, is bent and before the printed circuit board 2 is mounted. The shapes of the base 17 and the carrier part 21 correspond to the other example. The recess 23 is also provided. Unlike the first embodiment, the extension 28 on the lower side of the base fits a receiving socket. However, snap-in fastening is provided here as well.

Figure 7:
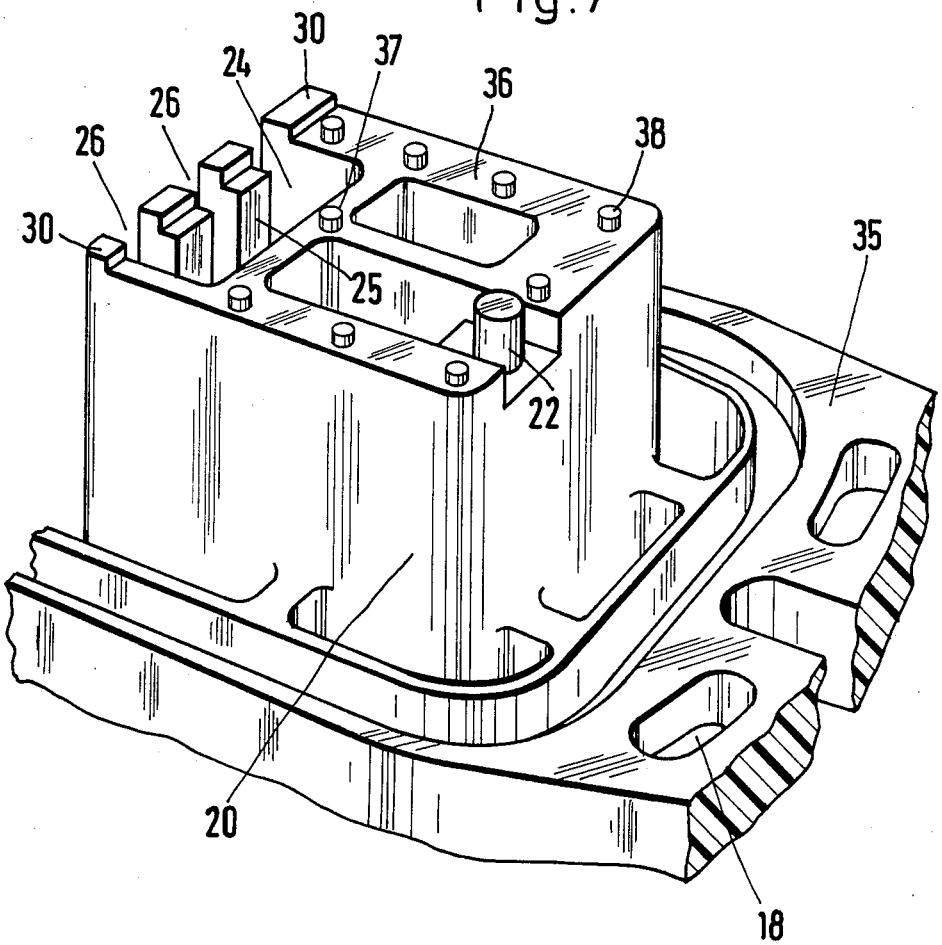
FIG. 7 is a perspective view of a cut-away carrier part as used in this invention, illustrated on a larger scale.
Figure 8:
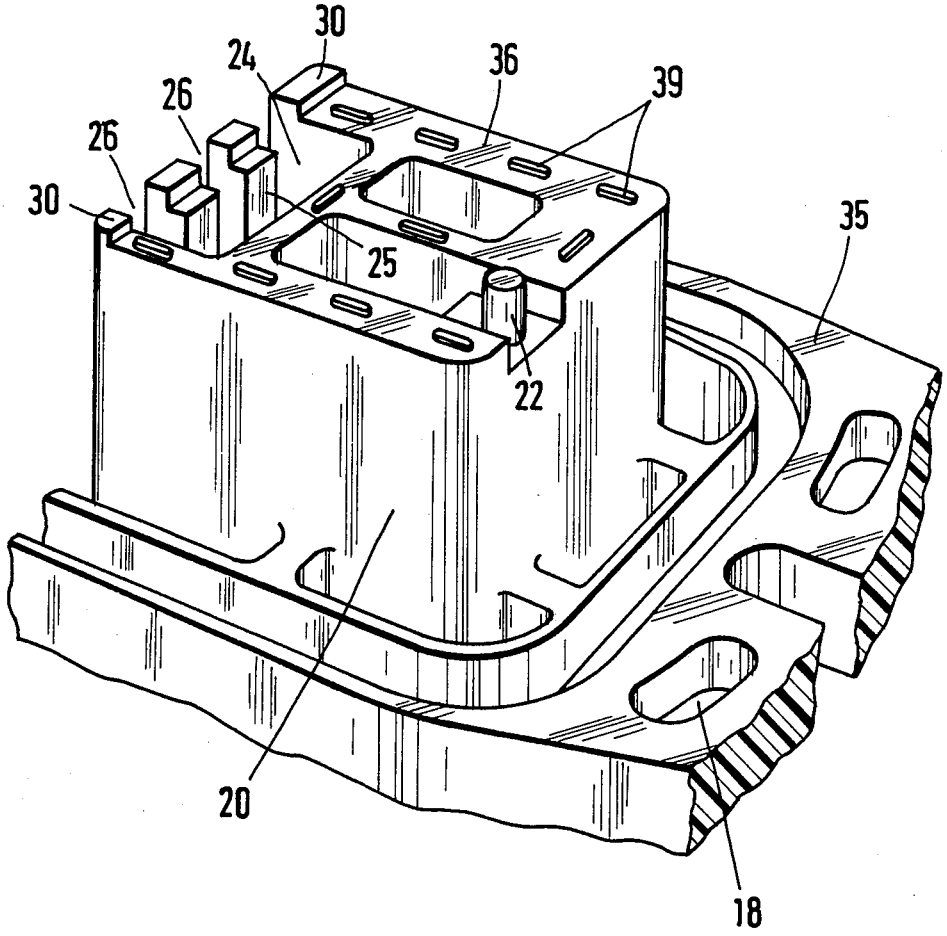
FIG. 8 is a perspective view of another embodiment of a carrier part.

To install the plug-type connector module as a potentiometer for a carburetor setting, it is necessary for the surface of the printed circuit board 2 to be as parallel as possible to the surface designated by 35 in FIGS. 1, 7 and 8. Deviations by up to 80 um are tolerated. Due to the differences in the shrinkage of the plastic, the deviations at the surface of the carrier part 20 are far greater than 150 um during the manufacture of the insulating carrier body. An adhesive mass 40 (FIG. 9) which remains elastic instead of hardening is used to fix the printed circuit board 2 on the carrier part 20. This adhesive mass has the property of pulling the printed circuit board to itself due to its intrinsic shrinkage, so that the mechanical stresses are generated in the ceramic plate. This ensures reliable contact. In order to compensate the above-mentioned variations, the distance between the first surface 35 and the second surface 36 on the carrier part is measured optically in various points on the surface. The distance is selected to be somewhat smaller than the nominal distance. The difference is compensated by a plurality of elevations which have different heights, corresponding to the shrinkage. Experiments have shown that the optimum value of the height is about 0.1 um. Such molded-on elevations are designated by 37 and 38 in FIG. 7. They have a round wart-like shape. Since these elevations are in an insert of the injection mold, their height can easily be determined later. Instead of the wart-like shape, the elevations 39 may also be in the form of short webs, as is shown in FIG. 8.

Figure 9:
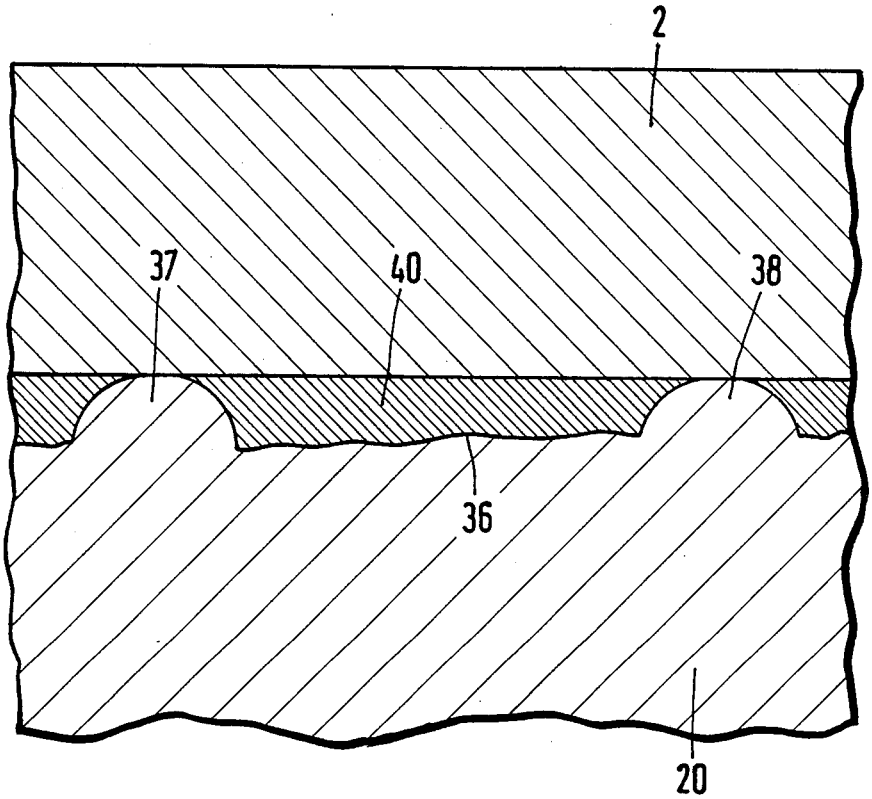
FIG. 9 is a sectional view of the carrier part of FIG. 7.

On a greatly enlarged scale, FIG. 9 shows the unevenness of the second surface 36 and the different heights of the elevations 37 and 38 which compensate it.

The molding of the elevations 37, 38 and 39 has the advantage that the adhesive mass 40 is distributed evenly under the ceramic plate and is not squeezed out on the sides on pressure, so that contamination is also avoided in this manner. If there were no elevations, it should be necessary to apply a much stronger force for pressing and positioning the ceramic plate. Due to the fact that there are elevations, the adhesive mass is able to flow easily into the spaces between the elevations during pressing, so that a much weaker pressing force is needed. This also diminishes the risk of mechanical damage to the ceramic plate, e.g., in the form of hairline cracks. Furthermore, the presence of the elevations also makes it possible to use an adhesive mass which is not particularly stable in volume, i.e., which undergoes greater shrinkage, because the plate is ultimately supported by the elevations and is held by the adhesive mass.

We claim:

1. Plug-type connector module apparatus with an insulating carrier body, a printed circuit board having at least one edge contact surface carried by said carrier body, the apparatus having at least one plug connection part for connecting to said printed circuit board, said plug connection part consisting of a front plug member with a portion thereof embedded in said carrier body, and of at least one contact member having an arc-shaped deformation; all of said at least one contact member being made from a single strip-shaped band of spring material and each of said at least one contact member having a free end having an approximately bell-shaped clamp plugged into said edge contact surface of said printed circuit board by clamp fit, each said fit solderable with soldering bath and and end part with a perforation in it, said perforation receiving said front plug member and said end part forming a solderable contact point for said plug member; characterized in that said carrier body comprises a base with a first, flat surface and with a carrier part rising from said first surface, said carrier part having a flat second surface which is parallel to said first surface, said printed circuit board being attached to said second surface with adhesive, said second surface having molded elevations under said printed circuit board, which said elevations have different pre-determined heights as a function of the distance between said first and second surfaces.

2. Plug-type connector module apparatus in accordance with claim 1, characterized in that said contact member has a symmetrical contour relative to the mid-plane of the clamp contour.

3. Plug-type connector module apparatus in accordance with claim 1, characterized in that said contact member has an asymmetrical contour relative to the mid-plane of the clamp countour.

4. Plug-type connector module in accordance with claim 1, characterized in that said front-plug member has such a shape that it can reach through said perforation.

5. Plug-type connector module apparatus in accordance with any one of claim 1–4, characterized in that said elevations are wart-shaped.

6. Plug-type connector module apparatus in accordance with any one of claims 1–4, characterized in that at least one of said elevations is in the form of a short web.

* * * * *